US005948480A

United States Patent [19]

Murphy

[11] Patent Number: 5,948,480

[45] Date of Patent: Sep. 7, 1999

[54] TANDEM APPLICATION OF SOIL AND STAIN RESISTS TO CARPETING

[75] Inventor: Peter Michael Murphy, Ooltewah, Tenn.

[73] Assignee: E.I. du Pont de Nemours and Company, Wilmington, Del.

[21] Appl. No.: 08/828,864

[22] Filed: Mar. 31, 1997

[51] Int. Cl.[6] ..... B05D 3/02

[52] U.S. Cl. ..... 427/393.4; 427/384; 427/412

[58] Field of Search ..... 427/393.4, 412, 427/384

[56] References Cited

U.S. PATENT DOCUMENTS

| | | | |
|---|---|---|---|
| 3,528,849 | 9/1970 | Vullo et al. | 427/393.4 |
| 3,816,229 | 6/1974 | Bierbrauber | 161/67 |
| 4,007,305 | 2/1977 | Kakar et al. | 427/322 |
| 4,312,914 | 1/1982 | Guth | 427/393.4 |
| 4,334,877 | 6/1982 | Gregorian et al. | 8/477 |
| 4,681,790 | 7/1987 | Fong | 428/96 |
| 4,857,392 | 8/1989 | Kirjanov et al. | 428/267 |
| 4,865,885 | 9/1989 | Herlant et al. | 427/322 |
| 5,074,883 | 12/1991 | Wang | 427/393.4 |
| 5,219,620 | 6/1993 | Potter et al. | 427/434.2 |
| 5,366,161 | 11/1994 | Potter et al. | 239/455 |
| 5,457,259 | 10/1995 | Elgarhy et al. | 428/224 |
| 5,478,603 | 12/1995 | Smith | 427/393.4 |
| 5,516,337 | 5/1996 | Nguyen | 427/393.4 |
| 5,520,962 | 5/1996 | Jones, Jr. | 427/393.4 |
| 5,670,246 | 9/1997 | Pechhold et al. | 428/267 |

FOREIGN PATENT DOCUMENTS

| | | |
|---|---|---|
| 0 090 788 A2 | 10/1983 | European Pat. Off. . |
| 0 353 080 A1 | 1/1990 | European Pat. Off. . |
| 0 579 976 A1 | 1/1994 | European Pat. Off. . |
| 60-199973 | 10/1985 | Japan . |
| 2 220 009 | 12/1989 | United Kingdom . |
| 2 285 982 | 8/1995 | United Kingdom . |
| WO 92/17636 | 10/1992 | WIPO . |
| WO 93/05224 | 3/1993 | WIPO . |
| WO 94/05848 | 3/1994 | WIPO . |

*Primary Examiner*—Janyce Bell

[57] ABSTRACT

A process for rendering carpet fiber resistant to stains and soil comprising a) applying to carpet fiber a first aqueous medium of at least one stain resist, b) applying to carpet fiber a second distinct aqueous medium of at least one fluorochemical soil resist, without any intervening steaming or rinsing, and c) drying the carpet, is disclosed.

9 Claims, No Drawings

TANDEM APPLICATION OF SOIL AND STAIN RESISTS TO CARPETING

FIELD OF THE INVENTION

This invention relates to a process for the application of a fluorochemical soil resist and a stain resist to polyamide, silk, and wool carpets in a tandem application without any intervening finishing step. The process allows application of stain and soil resists that would be incompatible in a single bath coapplication without adversely affecting the performance of either.

BACKGROUND OF THE INVENTION

Polyamides, silk, and wool fibers are subject to staining by a variety of agents, particularly acid dyes such as FD&C Red Dye No. 40, commonly found in soft drinks. Various stain resist agents have been used, including sulfonated phenol formaldehyde condensates and polycarboxylic acids such as those derived from methacrylic acid or maleic acid. Usually the stain resist agents are applied from an aqueous medium under conditions of controlled pH.

Additionally, polyamide, silk, and wool fibers are subject to soiling. Several of the currently used soil resist agents for nylon carpets are based on polymers derived from perfluoroalkylethyl alcohols. Typically the perfluoroalkylethyl alcohol derivatives are incorporated into acrylic or urethane polymers for application by foam, padding or spraying to various substrates.

Fluorochemical soil resist agents offer little protection from stains caused by acid dyes. Since the fluorochemical soil resist agents do not exhaust from aqueous solutions, they are usually applied in a separate operation from stain resists. Coapplication of the stain resist and soil resist would be more economical. Jones Jr. in U.S. Pat. No. 5,520,962 uses compatible soil/stain resists in a single bath. However, coapplication of conventional stain resists and soil resists often does not provide the desired properties. Additionally, coapplication techniques are not appropriate to all combinations of stain resists and fluorochemicals, especially when the two materials are incompatible or when one chemical impedes the exhaust efficiency of the other.

The incompatibilities result in such problems as phase separation and precipitation in the bath, increased bath viscosity, reduced wetting, excessive foaming, or other unacceptable physical changes which make the stain resist and/or the fluorochemical soil resist not perform on the carpet. Causes for these problems include incompatibilities in pH, concentration, mixed charges (e.g., anionic and cationic components), salt concentration, temperature, or other factors. For applications by exhaustion there may be competition between the soil resist and stain resist exhaust rates onto the fiber.

The nature of the competition between the fluorochemical and stain resist exhaust rates onto the fiber is not well understood. However, it is known that the single step or coapplication of compatible stain resists and fluorochemical soil resists typically encounters conflicting process requirements for optimum and efficient application for one chemical treatment or the other. Although both the stain resist and fluorochemical can be deposited onto the carpet, their final performance is not as good as when separate applications are employed.

Various processes for the separate application of stain and soil resists to carpets have been attempted. Typically a stain resist is applied followed by several finishing steps. This is then followed with a separate application of the fluorochemical soil resist followed by finishing steps. Attempts to apply both the stain resist and soil resist under stain resist conditions have resulted in poor performance due to the competition between the fluorochemical and stain resist exhaust rates onto the fiber. Attempts to apply both the stain and soil resist under the soil resist application conditions have also resulted in various product deficiencies.

It is desirable to have a process in which both the agents conferring soil and stain resistance can be applied whether or not the agents are mutually compatible, and for the finished product to display optimum performance for both treatments. The present invention describes such a process that allows both soil and stain resists to be applied in tandem with a single finishing step.

SUMMARY OF THE INVENTION

The present invention comprises a process for rendering carpet fiber resistant to stains and soil comprising a) applying to carpet fiber a first aqueous medium of at least one stain resist, b) applying to carpet fiber a second distinct aqueous medium of at least one fluorochemical soil resist without any intervening steaming or rinsing, and c) drying the carpet.

DETAILED DESCRIPTION OF THE INVENTION

The process of the present invention comprises the application of a fluorochemical soil resist and a stain resist separately, sequentially, in any order, followed by a final drying step. The process of the present invention simplifies the application process by making optional any finishing step, such as steaming or rinsing between the tandem application of the stain resist and the soil resist. Better stain and soil resist performances are obtained using the process of the present invention compared to a process in which the stain resist is applied followed by one or more finishing steps such as steaming, rinsing, vacuum extraction, or drying followed by the soil resist being applied and cured. The advantage over prior art single coapplications is that incompatible stain and soil resists can be used in this new process without adversely affecting the performance of either.

"Exhaustion" as used herein is a process by which a chemical treatment is transferred to a carpet by applying a water solution containing the chemical to the carpet. The conditions of the water solution are optionally changed (i.e., heating the wet carpet, changing the pH, adding a precipitant, etc.). Subsequently, the excess water and any chemical not bound to the carpet fiber can be removed from the carpet by physical means such as centrifugal separation or vacuuming. In an exhaust process a soluble bath component is absorbed from the bath onto the fiber. In exhaust applications, the water soluble chemical is partitioned between the water and the fiber, preferentially absorbing on the fiber. In such cases, the bath concentration is depleted more than in proportion to the wet pickup.

Fluorochemicals used as soil resists do not, strictly, exhaust because the fluorochemical soil resists used for carpets are not water soluble. The fluorochemical soil resist is either dispersed or emulsified in water with surfactants. The pH, the chemical interactions, and the temperature affect the ability of the surfactant to keep the fluorochemical dispersed or emulsified in water. The fluorochemical soil resist is precipitated onto the carpet pile.

A "coating" application is a process by which a chemical treatment is applied to a carpet in a water solution and water is evaporated by drying, leaving all of the non-volatile chemicals applied from the water solution as a coating on the carpet fibers. In nonexhaust applications, such a coating operation, the amount of chemical agent transferred to the fabric is determined solely by chemical concentration in the bath and the wet pickup of the carpet by the bath, as only water is removed when the carpet is heated and dried.

"Extraction" is a physical process to remove excess water and water soluble chemicals from the carpet using such means as centrifugal separation, passing the carpet over a vacuum slot, or passing the carpet between two or more closely spaced rolls to squeeze or nip the water from the carpet. A typical extraction step lowers the wet pickup of the carpet to between 50% and 80% of the dry carpet weight, depending on pre-extraction wet pickup of the carpet and the strength and efficiency of the vacuum. Extraction is commonly used when the wet pickup exceeds about 50% to reduce energy requirements for drying.

The term "bath" as used hereinafter refers to the aqueous solution or dispersion ready for application to the carpet. Both the soil resist and the stain resist baths are prepared conventionally according to the manufacturers' recommendations. Stain resist baths have a pH range between about 1 and about 6 and preferably between about 2 and about 3; soil resist baths have a pH range between about 1 and about 10 and preferably between about 4 and about 8.

The "wet pickup" is the total weight of applied liquid contained in the carpet divided by the weight of the original dry carpet, expressed as a percentage.

In the process of the present invention, a bath containing a soil resist is applied to the carpet at a low wet pickup of from about 5% to about 50%, preferably from about 5% to about 25%, and more preferably from about 10% to about 15%. Then, without any intervening finishing step such as steaming, rinsing, extraction, or drying, a second distinct bath containing a stain resist is applied to the carpet at an additional wet pickup of from about 20% to about 500%, preferably from about 20% to about 400% and more preferably from about 70% to about 250%. In one application method, the carpet is passed through the bath, but other application methods as noted below are suitable for use herein. The carpet, with total wet pickup in the range of 25% to 525%, and preferably 80% to 265%, is then dried. Both the stain and soil resists exhaust onto the fiber during application. Steaming, rinsing and extraction steps are optionally employed prior to drying.

The baths used in the present invention typically contain other components such as one or more acids to adjust pH including sulfuric, phosphoric, and sulfamic acids and blends thereof; salts such as calcium, sodium, potassium, or magnesium sulfate; anti-foaming additives such as silicones or hydrocarbons; and foaming or wetting agents such as alkyl sulfonates, ethoxylated fatty acids, ethoxylated fatty alcohols, alkyl aryl sulfonates.

The steaming, rinsing, and extraction steps are optional but preferred in most applications. When these steps are omitted, the dried carpet may exhibit harshness to the hand and may be more susceptible to fading and yellowing on exposure to sunlight and/or nitrogen oxides. The total wet pickup on the carpet usually should be kept to a minimum (normally less than 100% total wet pickup) when these steps are omitted. This limited wet pickup may cause the penetration of the stain and soil resist chemicals into the carpet pile to be insufficiently thorough to provide adequate protection of the bottom of the carpet tufts. However, in certain applications where these product qualities are less important, the reduced energy costs and the increased mill capacity associated with the steaming and/or rinsing steps justify their omission.

The typical conditions for steaming, when it is employed, are to use saturated steam at 210 to 214° F. (99 to 101° C.), for 20 to 200 seconds, and preferably saturated steam at 211 to 212° F. (99.4 to 100° C.) for 40 to 100 seconds. Typical conditions for rinsing and extraction, when employed, are rinsing with water at between 40 to 175° F. (5 to 80° C.) and with rinse wet pickup between about 40% and about 200%, and with rinse water raising the total wet pickup to between about 400% and about 600%, followed by extraction to between about 40% to about 100% wet pickup. However, rinsing and extraction conditions are not generally critical. The optional extraction is typically used prior to drying when the total wet pickup in any carpet process exceeds about 50%. This is the point at which extraction before drying becomes more efficient than just drying all the water. Any chemical treatment that is not bound to the carpet fiber prior to the extraction step is lost in proportion to the percentage of water extracted. Conditions for drying suitable for use in the present invention are to use hot air or radiant heat until the carpet face fiber reaches between 180 and 300° F. (82 to 150° C.) and preferable between 220 and 280° F. (104 to 138° C.).

In alternative embodiments of the present invention, spray, foam, flex-nip, nip (dip and squeeze), liquid injection, overflow flood, and other application methods well known to those skilled in the art, are suitable for use for tandem or sequential application of the stain and soil resists to the carpet, utilizing the baths described above. For instance, the low wet pickup bath system can be interchanged with low wet pickup spray or foam systems, and the high wet pickup bath system can be interchanged with other high wet pickup systems, e.g., flex-nip system, foam, pad, or flood. The method employed determines the appropriate wet pickup and whether the application is made from one side of the carpet (spray and foam applications) or both sides (flex-nip and pad).

In spray applications, the spray is applied according to the soil resist and stain resist manufacturer's recommendations, typically in single or double overlapping patterns to the top of the carpet pile. A spray application pressure of less than 60 psi (414 kPa) is used with a wet pickup of from about 5% to about 50% and usually about 10% to about 15% based on the carpet weight for fluorochemical soil resists, and a wet pickup of from about 20% to about 200% for stain resists.

In foam applications, the foam is applied according to the soil resist and stain resist manufactures' recommendations, typically in direct puddle applicators with a press roll or an injection manifold. It is applied to the top of the carpet pile with a wet pickup of typically of from about 5% to about 50% and preferably from about 10% to about 15% based on the carpet weight for fluorochemical soil resists and a wet pickup of from about 20% to about 200% for stain resists. Foam densities range between about 250 to about 50 grams/liter.

In flex-nip and in dip and squeeze applications, the carpet is passed into the center of a trough of an aqueous bath containing stain resist, acid, surfactants, and optionally salts, or other components prepared according to the stain resist manufacturer's recommendations. The carpet then exits the bottom of the trough between an air bladder with pressure of approximately 3–10 psi (21–69 kPa). This results in a wet pickup of between about 150% and about 300% as a ratio of the dry carpet weight, and typically about 200% wet pickup.

Other application methods, such as liquid injection and overflow flood, are also suitable for use in the present invention and constitute alternative methods for the application of treatment baths to carpet.

The following table provides a listing of methods of application for the stain resist and soil resist, together with typical and preferred wet pickup values for each method and each resist:

| Application Method | Typical Wet Pickup Range (%) | Preferred Pickup Range (%) |
|---|---|---|
| Stain resists | | |
| Flex-nip | 150–350 | 200–300 |
| Flood | 100–500 | 200–300 |
| Foam | 20–200 | 50–150 |
| Pad | 100–500 | 200–300 |
| Spray | 20–200 | 50–150 |
| Fluorochemical soil resists | | |
| Foam | 5–50 | 10–15 |
| Spray | 5–50 | 10–15 |

Many variations of the conditions for spray, foam, flex-nip, flood, and pad applications are well known to those skilled in the art and the preceding conditions are provided as examples and not are intended to be exclusive.

In yet another embodiment of the invention, the stain resist is applied before the soil resist. The sequential application is followed by drying. Steaming, rinsing and extraction steps are optional, and when employed are at the conditions previously discussed. Chemical considerations determine whether the soil resist application is preferably before or after the stain resist application. The important distinction of this invention is that the soil and stain resists are applied separately and both are applied before any finishing step.

Thus the practice of the present invention includes both the application sequence stain resist then soil resist and the application sequence soil resist then stain resist. The application sequence is dictated by the properties of the carpet, the manufacturing equipment available, and the chosen chemical treatments. Typically, spraying the fluorochemical soil resist after applying the stain resist gives better fluorine retention but poorer stain resistance than when the stain resist is applied before the soil resist.

A wide range of stain resists and soil resists are suitable for use in the practice of the present invention. Suitable stain resists are polymers containing phenol-formaldehyde, methacrylic acid, maleic acid, sulfonated fatty acids, and blends of the above. Suitable soil resists are polymers containing fluorochemical residues with the most preferred being cationically dispersed. The use of cationic fluorochemicals in combination with anionic stain resists typically gives better fluorine retention.

Suitable stain resists for the practice of this invention include, but are not limited to, phenol formaldehyde polymers or copolymers such as CEASESTAIN and STAINAWAY (from American Emulsions Company, Inc., Dalton, Ga.), MESITOL (from Bayer Corporation, Rock Hill, N.C.), ERIONAL (from Ciba Corporation, Greensboro, N.C.), INTRATEX (from Crompton & Knowles Colors, Inc., Charlotte, N.C.), STAINKLEER (from Dyetech, Inc., Dalton, Ga.), LANOSTAIN (from Lenmar Chemical Corporation, Dalton, Ga.), and SR-300, SR-400, and SR-500 (from E. I. du Pont de Nemours and Company, Wilmington, Del.); polymers of methacrylic acid such as the SCOTCHGARD FX series carpet protectors (from 3M Company, St. Paul Minn.); and sulfonated fatty acids from Rockland React-Rite, Inc., Rockmart, Ga.).

Suitable soil resists for the practice of the present invention include, but are not limited to, fluorochemical emulsions such as AMGUARD (from American Emulsions Company, Inc., Dalton, Ga.), SOFTECH (from Dyetech, Inc., Dalton Ga.), LANAPOL (from Lenmar Chemical Corporation, Dalton, Ga.), SCOTCHGARD FC series carpet protectors (from 3M Company, St. Paul, Minn.), NK GUARD (from Nicca USA, Inc., Fountain Head, N.C.), UNIDYNE (from Diakin America, Inc., Decatur, Ala.), and ZONYL 555, N-130 and N-119 (from E. I. du Pont de Nemours and Company, Wilmington, Del.).

Results indicate that even if the stain and soil resists are compatible and can be coapplied simultaneously from a single bath, sequential tandem application results in better performing stain and soil resists than when the materials are coapplied in the same bath. As shown in the examples, a coapplication of a stain resist and soil resist demonstrated poorer performance than sequential tandem application of a soil resist followed by application of a stain resist.

In the invention described here, the fluorochemical and the stain resist are applied separately without an intervening finishing step. The process of the present invention is useful to provide a better degree of stain and soil resistance than when the stain resist treatment is applied, steamed, and then the soil resist is applied. It is also useful for employing incompatible stain and soil resists without adversely affecting the performance of either. Stain and soil resistance as well as water repellency are desired attributes for residential and commercial carpeting. This invention gives maximum repellency on the carpet in a more economic process.

The following testing methods were employed in the examples.

Method 1 Determination of Oil and Water Repellency 1.a. Oil Repellency Test

Oil repellency was measured according to the American Association of Textile Chemists and Colorists (AATCC) Standard Test 188-1978, which is based on the resistance of treated fiber or fabric to penetration of oils of varying surface tensions at a scale of 0 to 8. A rating of 8 is given to the least oil penetrating (most oil repellent) surface. Results for untreated, control, and example soil tests by this procedure are shown in Table 2 below.

1.b. Water Repellency Test

Water repellency was measured according to DuPont "Teflon" (Wilmington, Del.) Standard Test Method #311.56. After conditioning for 4 hours at 70° F. (21° C.) and 65% relative humidity, the fabric is placed on a flat level surface. Three drops of the selected water/isopropanol mixture (see Table 1, below) are placed on the fabric and left for 10 seconds. If no penetration has occurred, the fabric is judged to "pass" this level of repellency and the next higher numbered test liquid is tested. The fabric rating is the highest numbered test liquid that does not wet the fabric.

TABLE 1

Water/Isopropanol Mixtures for the Water Repellency Test

| Water Repellency Rating | Composition (wt. %) | |
|---|---|---|
| Number | Water | Isopropanol |
| 1 | 98 | 2 |
| 2 | 95 | 5 |
| 3 | 90 | 10 |
| 4 | 80 | 20 |
| 5 | 70 | 30 |
| 6 | 60 | 40 |

A rating of 0 indicates no water repellency, a rating of 6 indicates maximum water repellency. Results for untreated, control, and example soil tests by this procedure are shown in Table 2 below.

Method 2 24-Hour FD&C Red No. 40 Staining

Stain Test (AATCC-175-1991)

Acid dye stain resistance was evaluated using a procedure based on the American Association of Textile Chemists and Colorists (AATCC) Method 175-1991, "Stain Resistance: Pile Floor Coverings." A staining solution was prepared by mixing water and sugar sweetened cherry Kool-Aid® according to package directions. Alternatively the solution is prepared by mixing 0.2 g of FD&C Red No. 40 and 3.2 g of citric acid in one liter of deionized water. The carpet sample to be tested was placed on a flat non-absorbent surface and a hollow plastic cylinder having a 3-inch (7.6 cm) diameter was placed tightly over the carpet sample. Twenty ml of staining solution was poured into the cylinder and the solution was allowed to absorb completely into the carpet sample. The cylinder was then removed and the stained carpet sample was allowed to sit undisturbed for 24 hours, after which it was rinsed thoroughly under cold tap water and squeezed dry.

The carpet sample was then visually inspected and rated for staining according to AATCC Red 40 Stain Scale. A stain rating of 10 is excellent, showing outstanding stain resistance, whereas 1 is the poorest rating, comparable to an untreated control sample. Results for control and example stain tests by this procedure are shown in Table 2 below.

Method 3 Shampoo-Wash Durability Test

A treated carpet specimen, approximately 3×5 inch (7.6×12.7 cm), is submerged for 5 minutes at room temperature in a detergent solution consisting of sodium lauryl sulfate (dodecyl sodium sulfate) such as "Duponol WAQE" (1.5 g per liter) and adjusted with dilute sodium carbonate to a pH value of 10. The specimen is then removed, rinsed thoroughly under tap water, de-watered by squeezing, and air-dried. The dry carpet specimen is then tested according to the stain test described above. Results for the examples and comparative example are show in Table 2 below.

EXAMPLES

The following soil resists, stain resists, and other materials were used in the examples.

ZONYL 555 Carpet Protector is a cationic fluorochemical soil resist prepared according to U.S. Pat. No. 4,958,039 and available from E. I. du Pont de Nemours and Company, Wilmington Del.

N-130 and N-119 are anionic polyfluoro nitrogen-containing soil resists prepared according to U.S. Pat. No. 5,580,645 using sodium alkyl sulfonates as the surfactant to stabilize the emulsion. The two soil resists are available from E. I. du Pont de Nemours and Company, Wilmington Del. and are anionically dispersed.

SR-300, SR-400, and SR-500 are water soluble anionic stain resists available from E. I. du Pont de Nemours and Company, Wilmington Del. SR-300 is prepared according to U.S. Pat. No. 5,057,121, SR-400 is prepared according to U.S. Pat. No. 4,883,839, and SR-500 is prepared according to U.S. Pat. No. 5,460,887.

Duponol WAQE is a mixture of sodium lauryl sulfates available from Witco Chemical Co., Greenwich Conn.

Example 1

A dyed light blue 30 oz./yd.$^2$ (1 kg/m$^2$) tufted, cut pile carpet (made from twisted, Superba heatset, 1410 DuPont fiber, from E. I. du Pont de Nemours and Company, Wilmington Del.) was sprayed with 30% wet pickup of a bath containing 18 g/L of N-119 Soil Resist. A flex-nip application of 250% by weight of a bath containing 16 g/L of SR-500 Stain Resist was then made. The carpet was steamed at 210–212° F. (99–100° C.) for 2.5 min., and washed with water. It was then vacuum extracted to 50% wet pickup, and dried to a carpet face temperature of 300° F. (149° C.). The dried carpet was tested according to the methods above and the results are shown in Table 2 below.

Example 2

Lightly dyed carpet as in Example 1 was sprayed with 30% wet pickup of a bath containing 20 g/L of ZONYL 555 Soil Resist. Then a flex-nip application of 250% by weight of a bath containing 16 g/L of SR-500 Stain Resist was made. The carpet was steamed at 210–212° F. (99–100° C.) for 2.5 min., and washed with water. It was then vacuum extracted to 50% wet pickup, and dried to a carpet face temperature of 300° F. (149° C.). The dried carpet was tested according to the methods above and the results are shown in Table 2 below.

Example 3

Lightly dyed carpet as in Example 1 was given a flex-nip application of 250% by weight of a bath containing 16 g/L of SR-300 Stain Resist. It was then sprayed with 30% wet pickup of a bath containing 20 g/L of ZONYL 555 Soil Resist, and steamed at 210–212° F. (99–100° C.) for 4 min. It was rinsed with water, vacuum extracted to 50% wet pickup, and dried to a carpet face temperature of 300° F. (149° C.). The dried carpet was tested according to the methods above and the results are shown in Table 2 below.

Comparative Example A

Lightly dyed carpet as in Example 1 was given a flex-nip application of 250% by weight of a bath containing 14 g/L of SR-400 Stain Resist. It was then steamed at 210–212° F. (99–100° C.) for 2.5 min. It was rinsed with water, and vacuum extracted to 50% wet pickup. It was then sprayed with 15% wet pickup of a bath containing 20 g/L of N-130 Soil Resist. It was dried to a carpet face temperature of 300° F. (149° C.) in a gas fired oven. The dried carpet was tested according to the methods above and the results are shown in Table 2 below.

TABLE 2

| | | Carpet Testing | | |
|---|---|---|---|---|
| | | Test Method | | |
| Example | Fluorine Content | 1.a, b Oil/Water Repellency | 2 24 hr FD&C Red #40 Staining | 3 Shampoo-Wash Durability |
| Example 1 | 111 ppm | 3/6 | 9.5 | 9 |
| Example 2 | 223 ppm | 0/4 | 9.5 | 9.5 |
| Example 3 | 330 ppm | 3/3 | 9 | 2 |
| Comparative Example A | 349 ppm | 0/3 | 9 | 6 |

The results in Table 2 indicate superior oil repellency in Examples 1 and 3, superior water repellency in Examples 1 and 2, superior stain resistance in Examples 1 and 2, and superior durability of stain resistance in Examples 1 and 2, in each case using the tandem application of the present invention when compared with Comparative Example A, even though the fluorine loading in the Comparative Example is substantially higher than in Examples 1 and 2. In the Comparative Example A intervening finishing steps were employed between application of the stain resist and the soil resist.

Comparative Example B

To a dyed light blue 30 oz./yd.$^2$ (1 kg/m$^2$) tufted, cut pile carpet (made from twisted, Superba heatset, 1410 DuPont fiber, from E. I. du Pont de Nemours and Company, Wilmington, Del.) a flex-nip application of 250% by weight of a bath containing both 16 g/L of SR-500 Stain Resist and 2.0 g/L of N-119 Soil Resist at a pH of 2.0 was made. The carpet was steamed at 210–212° F. (99–100° C.) for 2.5 minutes and rinsed with water. It was then vacuum extracted to 50% wet pickup, and dried to a carpet face temperature of 300° F. (149° C.). The dried carpet was tested according to the methods above and the results are shown in Table 3 below.

TABLE 3

| | | Carpet Testing | | |
|---|---|---|---|---|
| | | Test Method | | |
| Example | Fluorine Content | 1.a, b Oil/Water Repellency | 2 24 hr FD&C Red #40 Staining | 3 Shampoo-Wash Durability |
| 1 | 111 ppm | 3/6 | 9.5 | 9 |
| Comparative Example B | 59 ppm | 0/3 | 9 | 8.5 |

The data in Table 3 indicate superior oil and water repellency, stain resistance, and durability of stain resistance for Example 1 using the tandem application process of the present invention when compared to Comparative Example B in which simultaneous coapplication of the stain resist and soil resist was employed.

What is claimed is:

1. A process for rendering carpet fiber resistant to stains and soil comprising a) applying to carpet fiber a first aqueous medium of at least one stain resist, b) applying to carpet fiber a second distinct aqueous medium of at least one fluorochemical soil resist, without any intervening steaming or rinsing, and c) drying the carpet.

2. A process for rendering carpet fiber resistant to stains and soil comprising a) applying to carpet fiber a first aqueous medium of at least one fluorochemical soil resist by means of foam or spray application, b) applying to carpet fiber a second distinct aqueous medium of at least one stain resist, without any intervening steaming or rinsing, and c) drying the carpet.

3. The process of claim 1 or 2 wherein the stain resist is applied at a wet pickup of from about 20% to about 500%.

4. The process of claim 1 or 2 wherein the soil resist is applied at a wet pickup of from about 5% to about 50%.

5. The process of claim 1 or 2 wherein the carpet fiber is polyamide, wool or silk.

6. The process of claim 1 or 2 wherein the stain resist is anionically emulsified or dispersed in the aqueous medium.

7. The process of claim 6 wherein the soil resist is cationically emulsified or dispersed in an aqueous medium.

8. The process of claim 1 or 2 further comprising steaming the carpet followed by rinsing the carpet with water prior to drying.

9. The process of claim 1 or 2 wherein the application of the stain resist is at a pH of from about 1 to about 6, and the application of the soil resist is at a pH of from about 1 to about 10.

* * * * *